US008607406B2

(12) United States Patent
Miefalk et al.

(10) Patent No.: US 8,607,406 B2
(45) Date of Patent: Dec. 17, 2013

(54) HAND HELD VACUUM CLEANER

(75) Inventors: Häkan Miefalk, Järfälla (SE); Fredrik Bergling, Skäret (SE); Stefan Jonsson, Stockholm (SE); Esbjörn Svantesson, Stockholm (SE); Christian Ågren, Stockholm (SE)

(73) Assignee: AB Electrolux (SE)

( * ) Notice: Subject to any disclaimer, the term of this patent is extended or adjusted under 35 U.S.C. 154(b) by 0 days.

(21) Appl. No.: 13/555,560

(22) Filed: Jul. 23, 2012

(65) Prior Publication Data

US 2013/0031742 A1 Feb. 7, 2013

Related U.S. Application Data

(63) Continuation of application No. 10/544,927, filed as application No. PCT/SE2004/000136 on Jan. 30, 2004, now Pat. No. 8,225,456.

(30) Foreign Application Priority Data

Feb. 10, 2003 (SE) ..... 0300355

(51) Int. Cl.
*A47L 5/26* (2006.01)

(52) U.S. Cl.
USPC ..... 15/328; 15/329; 15/344; 15/410; 15/DIG. 1

(58) Field of Classification Search
USPC ..... 15/328, 329, 339, 344, 410, DIG. 1
IPC ..... A47I 5/26
See application file for complete search history.

(56) References Cited

U.S. PATENT DOCUMENTS

| | | | |
|---|---|---|---|
| 2,707,792 | A | 5/1955 | Waller |
| 2,863,524 | A | 12/1958 | Buda |
| 3,199,138 | A | 8/1965 | Nordeen |
| 3,621,640 | A | 11/1971 | Ohno et al. |
| 3,653,189 | A | 4/1972 | Miyake et al. |
| 3,906,219 | A | 9/1975 | Stauffer |
| 4,213,224 | A | 7/1980 | Miller |

(Continued)

FOREIGN PATENT DOCUMENTS

| | | |
|---|---|---|
| CA | 2087056 | 7/1994 |
| CN | 1272873.X | 1/2003 |

(Continued)

OTHER PUBLICATIONS

"The BOSS, Heavy Duty Rechargeable Vacuum, Model 98," Eureka brochure dated 1998, 2 pages.

(Continued)

*Primary Examiner* — David Redding
(74) *Attorney, Agent, or Firm* — RatnerPrestia

(57) ABSTRACT

A vacuum cleaner apparatus for securing a hand held vacuum cleaner having a housing, the housing comprising a motor-fan unit, a dust container, and an air passage. The vacuum cleaner apparatus has a shaft part to which the housing can be secured, the shaft part comprising a handle and one or more batteries. The vacuum cleaner apparatus also has a floor nozzle and a tube passage configured to connect the floor nozzle to the air passage when the housing is secured to the shaft part.

8 Claims, 7 Drawing Sheets

(56) References Cited

U.S. PATENT DOCUMENTS

| | | | |
|---|---|---|---|
| 4,276,070 | A | 6/1981 | Hug |
| 4,376,322 | A | 3/1983 | Lockhart et al. |
| 4,421,964 | A | 12/1983 | Buchtel |
| 4,467,493 | A | 8/1984 | Buchtel |
| 4,541,142 | A | 9/1985 | Pudwill |
| 4,545,089 | A | 10/1985 | Oxel |
| 4,573,234 | A | 3/1986 | Kochte et al. |
| 4,573,237 | A | 3/1986 | Kochte et al. |
| 4,621,390 | A | 11/1986 | Hampton et al. |
| 4,635,315 | A | 1/1987 | Kozak |
| 4,665,582 | A | 5/1987 | Richmond et al. |
| 4,670,701 | A | 6/1987 | Sako et al. |
| 4,704,765 | A | 11/1987 | Ataka |
| 4,748,713 | A | 6/1988 | Sepke et al. |
| 4,766,638 | A | 8/1988 | McDowell |
| 4,787,923 | A | 11/1988 | Fleigle et al. |
| 4,804,481 | A | 2/1989 | Lennartz |
| D300,214 | S | 3/1989 | Adams |
| 4,821,366 | A | 4/1989 | Levine |
| 4,831,685 | A | 5/1989 | Bosyj et al. |
| 4,841,594 | A | 6/1989 | Elson et al. |
| D304,104 | S | 10/1989 | Busalt et al. |
| 4,876,763 | A | 10/1989 | Cho et al. |
| 4,894,882 | A | 1/1990 | Toya |
| 4,899,418 | A | 2/1990 | Steiner et al. |
| D307,657 | S | 5/1990 | Li |
| 4,920,606 | A | 5/1990 | Gerke, Jr. et al. |
| 4,920,608 | A | 5/1990 | Hult et al. |
| 4,928,346 | A | 5/1990 | Elson et al. |
| 4,934,020 | A | 6/1990 | Jackson |
| 4,942,641 | A | 7/1990 | Gerke, Jr. et al. |
| 4,947,514 | A | 8/1990 | Gerke, Jr. et al. |
| 4,967,443 | A | 11/1990 | Krasznai et al. |
| 4,993,106 | A | 2/1991 | Hult et al. |
| 5,005,252 | A | 4/1991 | Steiner et al. |
| 5,020,187 | A | 6/1991 | Kosten et al. |
| 5,025,529 | A | 6/1991 | Hult et al. |
| 5,035,024 | A | 7/1991 | Steiner et al. |
| 5,065,473 | A | 11/1991 | Krasznai et al. |
| 5,107,567 | A | 4/1992 | Ferrari et al. |
| 5,309,600 | A | 5/1994 | Weaver et al. |
| 5,322,534 | A | 6/1994 | Kaiser |
| 5,342,433 | A | 8/1994 | Avondoglio |
| D352,807 | S | 11/1994 | Sanderud |
| D364,013 | S | 11/1995 | Klingspor et al. |
| 5,524,321 | A | 6/1996 | Weaver et al. |
| 5,561,885 | A | 10/1996 | Zahuranec et al. |
| 5,584,095 | A | 12/1996 | Redding et al. |
| 5,603,740 | A | 2/1997 | Roy |
| 5,661,885 | A | 9/1997 | Donato |
| 5,715,566 | A | 2/1998 | Weaver et al. |
| 5,733,351 | A | 3/1998 | Hult et al. |
| 5,819,364 | A | 10/1998 | Sham |
| 5,869,947 | A | 2/1999 | Zahuranec et al. |
| 5,966,774 | A | 10/1999 | Bone et al. |
| 6,029,313 | A | 2/2000 | O'Dea et al. |
| 6,094,775 | A | 8/2000 | Behmer |
| 6,108,864 | A | 8/2000 | Thomas et al. |
| 6,122,796 | A | 9/2000 | Downham et al. |
| 6,125,498 | A | 10/2000 | Roberts et al. |
| 6,131,239 | A | 10/2000 | White |
| 6,146,434 | A | 11/2000 | Scalfani et al. |
| 6,189,178 | B1 | 2/2001 | Roberts |
| 6,311,366 | B1 | 11/2001 | Sepke et al. |
| 6,324,714 | B1 | 12/2001 | Walz et al. |
| 6,428,589 | B1 | 8/2002 | Bair et al. |
| 6,434,785 | B1 | 8/2002 | Vandenbelt et al. |
| 6,546,592 | B1 | 4/2003 | Cockburn et al. |
| 6,562,093 | B2 | 5/2003 | Oh |
| 6,571,421 | B1 | 6/2003 | Sham et al. |
| 6,625,845 | B2 | 9/2003 | Matsumoto et al. |
| 6,647,587 | B1 | 11/2003 | Ohara et al. |
| 6,658,693 | B1 | 12/2003 | Reed, Jr. |
| 6,736,873 | B2 | 5/2004 | Conrad et al. |
| 6,766,558 | B1 | 7/2004 | Matsumoto et al. |
| 6,775,882 | B2 | 8/2004 | Murphy et al. |
| 6,811,584 | B2 | 11/2004 | Oh |
| 6,824,580 | B2 | 11/2004 | Oh |
| 6,839,934 | B2 | 1/2005 | Houghton et al. |
| 6,857,165 | B2 | 2/2005 | Oh |
| 6,928,690 | B2 | 8/2005 | Ji |
| 6,948,211 | B2 | 9/2005 | Stephens et al. |
| 6,964,082 | B2 | 11/2005 | Hsu |
| 6,968,596 | B2 | 11/2005 | Oh et al. |
| 7,377,007 | B2 | 5/2008 | Best |
| 7,383,609 | B2 | 6/2008 | Ji |
| 7,386,916 | B2 | 6/2008 | Bone |
| 7,404,838 | B1 | 7/2008 | Pathak |
| 7,412,749 | B2 | 8/2008 | Thomas et al. |
| 7,507,269 | B2 | 3/2009 | Murphy et al. |
| 2002/0042969 | A1 | 4/2002 | Nagai et al. |
| 2002/0073504 | A1 | 6/2002 | Hall et al. |
| 2002/0189048 | A1 | 12/2002 | Maruyama et al. |
| 2003/0019073 | A1 | 1/2003 | Oh |
| 2003/0159235 | A1 | 8/2003 | Oh |
| 2003/0163887 | A1 | 9/2003 | Inoue |
| 2003/0208879 | A1 | 11/2003 | Oh et al. |
| 2003/0213091 | A1 | 11/2003 | Oh et al. |
| 2004/0040270 | A1 | 3/2004 | Inoue et al. |
| 2004/0098957 | A1 | 5/2004 | Yoo et al. |
| 2004/0103496 | A1 | 6/2004 | Worwag |
| 2004/0134022 | A1 | 7/2004 | Murphy et al. |
| 2004/0177471 | A1 | 9/2004 | Jung et al. |
| 2004/0187253 | A1 | 9/2004 | Jin et al. |
| 2004/0200029 | A1 | 10/2004 | Jin et al. |
| 2004/0216263 | A1 | 11/2004 | Best |
| 2004/0261212 | A1 | 12/2004 | Park et al. |
| 2004/0261213 | A1 | 12/2004 | Park et al. |
| 2005/0005390 | A1 | 1/2005 | Lee et al. |
| 2005/0005391 | A1 | 1/2005 | Park |
| 2005/0081321 | A1 | 4/2005 | Milligan et al. |
| 2005/0125939 | A1 | 6/2005 | Hansen et al. |
| 2005/0125940 | A1 | 6/2005 | McDowell |
| 2005/0183406 | A1 | 8/2005 | Coburn |
| 2006/0064828 | A1 | 3/2006 | Stein et al. |
| 2006/0090290 | A1 | 5/2006 | Lau |
| 2006/0156508 | A1 | 7/2006 | Khalil |
| 2007/0163075 | A1 | 7/2007 | Butler et al. |
| 2007/0271724 | A1 | 11/2007 | Hakan et al. |

FOREIGN PATENT DOCUMENTS

| | | | |
|---|---|---|---|
| DE | G 79 29 844.5 | | 3/1981 |
| DE | 32 28 491 | A1 | 2/1984 |
| DE | 33 09 162 | A1 | 9/1984 |
| DE | 33 25 336 | | 1/1985 |
| DE | 8623004 | | 10/1986 |
| DE | 37 43 083 | A1 | 6/1989 |
| DE | G 90 10 066.2 | | 10/1991 |
| DE | G 91 14 371.3 | | 4/1992 |
| DE | 4038262 | | 6/1992 |
| DE | 19630286 | | 1/1998 |
| DE | 10110581 | | 11/2001 |
| DE | 10124216 | | 1/2002 |
| EP | 0 170 720 | | 2/1986 |
| EP | 0 215 619 | A2 | 3/1987 |
| EP | 0 827 710 | A2 | 3/1998 |
| EP | 0853917 | | 7/1998 |
| EP | 0914795 | A2 | 12/1999 |
| EP | 1 070 478 | | 1/2001 |
| EP | 1224898 | | 7/2002 |
| EP | 1 279 362 | | 1/2003 |
| FR | 2603181 | | 6/1987 |
| GB | 857580 | | 12/1960 |
| GB | 990065 | | 4/1965 |
| GB | 1201841 | | 8/1970 |
| GB | 2035787 | A | 6/1980 |
| GB | 2137896 | | 10/1984 |
| GB | 2155314 | | 9/1985 |
| GB | 2189382 | A | 10/1987 |
| GB | 2268875 | | 1/1994 |
| GB | 2291790 | | 7/1994 |
| GB | 2 349 105 | | 10/2000 |
| GB | 2 372 434 | | 8/2002 |

(56) References Cited

FOREIGN PATENT DOCUMENTS

| | | | |
|---|---|---|---|
| GB | 2398486 | A | 8/2004 |
| GB | 2413942 | | 11/2005 |
| JP | 54-100149 | | 8/1979 |
| JP | 3-267032 | | 11/1991 |
| JP | 4364822 | | 12/1992 |
| JP | 52-73557 | | 10/1998 |
| JP | 2000-070198 | | 3/2000 |
| JP | 2001-095735 | | 4/2001 |
| JP | 2001353110 | | 12/2001 |
| JP | 2002 085297 | A | 3/2002 |
| JP | 2002 136456 | A | 5/2002 |
| JP | 2003 275154 | A | 9/2003 |
| JP | 4364822 | | 11/2009 |
| SE | 514314 | C2 | 3/1998 |
| SE | 510283 | C2 | 10/1998 |
| WO | WO 97/20492 | | 6/1997 |
| WO | WO 03/009736 | | 2/2003 |
| WO | WO 2004/069021 | | 8/2004 |
| WO | WO 2005/111084 | | 11/2005 |

OTHER PUBLICATIONS

Color printouts of http://www.zweita.net/ "Product Info" (3 pages).
Color printouts of http://www.igia.com/prodetail.cfm?ID=AT7290 "IGIA Vac Blue" (3 pages).
Color printouts of http://www.igia.com/prodetail.cfm?ID=AT7739 "Wind Storm Vacuum" (3 pages).
Color printouts of http://www.igia.com/prodetail.cfm?ID=AT7691 "Wind Storm Wet/Dry Vacuum" (1 page).
Color printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds" (4 pages).
Color printouts of http://www.sewserg.com/products/abp02698.html Miele S147 Little Giant Plus Vacuum Cleaner with Free 5 YR Extended Warranty/Replacement.
Fakir product pages catalogue, 2002 (5 pages).
Black & white printouts of http://www.zweita.net/ "Product Info" (3 pages).
Black & white printouts of http://www.igia,com/prodetail.cfm?ID=AT7290 "IGIA Vac Blue" (3 pages).
Black & white printouts of http://www.igia.com/prodetail.cfm?ID=AT7739 "Wind Storm Vacuum" (3 pages).
Black & white printouts of http://www.igia.com/prodetail.cfm?ID=AT7691 "Wind Storm Wet/Dry Vacuum" (1 page).
Black & white printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds" (3 pages).
Black & white printouts of http://www.sewserg.com/products/abp02698.html Miele S147 Little Giant Plus Vacuum Cleaner with Free 5 YR Extended Warranty/Replacement (3 pages).

HAND HELD VACUUM CLEANER

FIELD OF THE INVENTION

This application is a continuation of U.S. application Ser. No. 10/544,927, filed Apr. 13, 2007, now U.S. Pat. No. 8,225,456, which was filed under 35 USC §371 of International Application No. PCT/SE2004/000136 filed Jan. 30, 2004 which claims priority to Swedish Application No. 0300355-5 filed on Feb. 10, 2003, the disclosure of each which is included herein by reference in its entirety. This invention relates to a hand held vacuum cleaner comprising a housing supporting a motor-fan unit, a dust container and an air passage ending in the dust container through which dust laden air is directed into the dust container, the vacuum cleaner also comprising at least one filter arranged after the dust container as seen in the flow direction, the dust container constituting a part of a cyclone separator arranged between the air passage and the filter.

BACKGROUND

Hand held vacuum cleaners which are battery powered as well as powered by mains supply, are previously known, see for instance U.S. Pat. No. 4,967,443, and are used for fast cleaning of small surfaces. It is important that such vacuum cleaners are easily accessible and user friendly designed. These vacuum cleaners are usually designed such that the dust container together with the filter can be removed from the remaining part of the vacuum cleaner housing that contains the fan unit. In order to empty the vacuum cleaner also the filter has to be removed from the dust container before the content can be emptied through the opening which is established when the filter has been taken away. Removal of the dust from the dust container is hence troublesome, dirty and time consuming. It should in this connection be mentioned that the volume of the dust container for this type of vacuum cleaners is very limited and that the filter is rapidly clogged which means lost suction efficiency and that emptying has to be done with short intervals.

It is further known, see EP 914795, to provide a hand held vacuum cleaner of the type mentioned above with a large opening covered by a pivotable lid in order to facilitate emptying but since the dust usually gets stuck to the filter the dust can not be easily poured out of the opening. Moreover since the conventional filter system is quickly clogged the suction efficiency is still not sufficient.

It is also previously known to use the type of hand held vacuum cleaner described above in combination with a shaft part whose, lower portion supports a nozzle (so called stick cleaner), see for instance SE 9701543-2. The shaft part is provided with a tube connection by means of which dust laden air is transferred from the nozzle to the air inlet of the hand held vacuum cleaner which is removably secured to the shaft part. This means that the combined stick cleaner in a comfortable way can be used for floor cleaning purpose. Of course this type of vacuum cleaners also has the same disadvantages as the hand held vacuum cleaner described above with respect to filter clogging and handling when being emptied.

SUMMARY OF THE INVENTION

The purpose of this invention is to create an arrangement which eliminates a too fast clogging of the filter and which facilitates emptying of the vacuum cleaner at the vacuum cleaner types described above. This is achieved by means of a device having the characteristics mentioned in the claims.

In a first aspect, the present invention provides a hand held vacuum cleaner having a housing, a motor-fan unit, a dust container, an air passage opening into the dust container and through which dust laden air is directed into the dust container, and at least one filter arranged after the dust container, as seen in the flow direction. The dust container has a first emptying opening, which is normally being covered by a lid and is sized such that it allows the dust collected in the dust container to fall out through the opening when the lid is opened. The dust container also has a second emptying opening that is adapted to be fluidly connected to an external vacuum source via a connection.

In a second aspect, the present invention provides a vacuum cleaner having a housing, a motor-fan unit contained in the housing and having a motor-fan inlet opening, an air inlet passage, and a dust container selectively attachable to the housing. The dust container has a container air inlet adapted to be in fluid communication with the air inlet passage when the dust container is attached to the housing, a container air outlet located at a first end of the dust container and adapted to be in fluid communication with the motor-fan inlet opening when the dust container is attached to the housing, a filter positioned between the container air inlet and the container air outlet, a first emptying opening having a first cover associated therewith, and a second emptying opening having a second cover associated therewith. In this aspect, the dust container can be emptied through the first emptying opening without removing the dust container from the housing.

In a third aspect, the present invention provides a dust container for a vacuum cleaner. The dust container has an air inlet, an air outlet, a first dirt outlet, and a second dirt outlet. The first and second dirt outlets are separate from the air outlet.

BRIEF DESCRIPTION OF THE DRAWINGS

An embodiment of the invention will now be described with reference to the accompanying drawings in which.

DETAILED DESCRIPTION OF PREFERRED EMBODIMENTS

Figure 1:
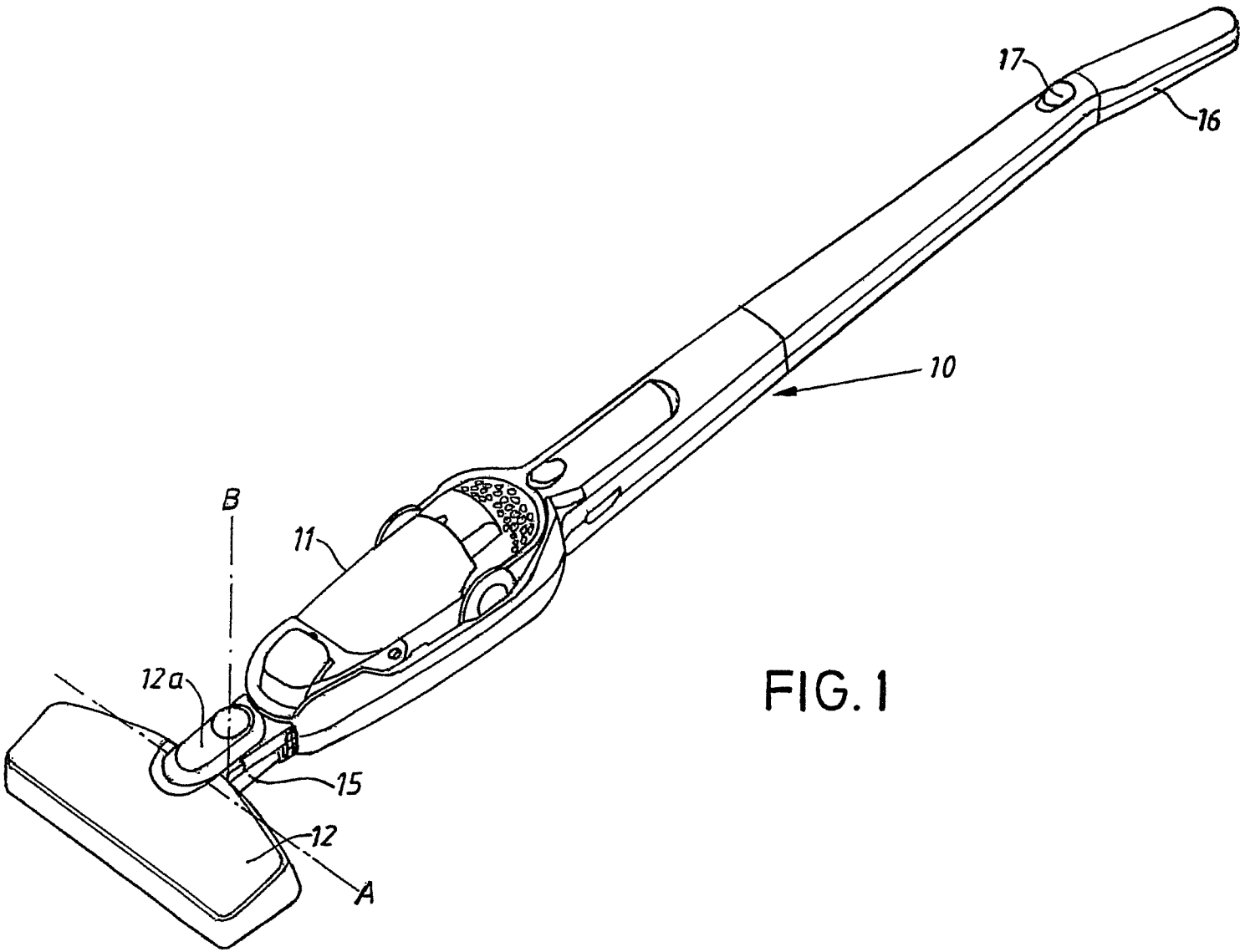
FIG. 1 is a perspective view of the vacuum cleaner in question together with a shaft part.
Figure 2:
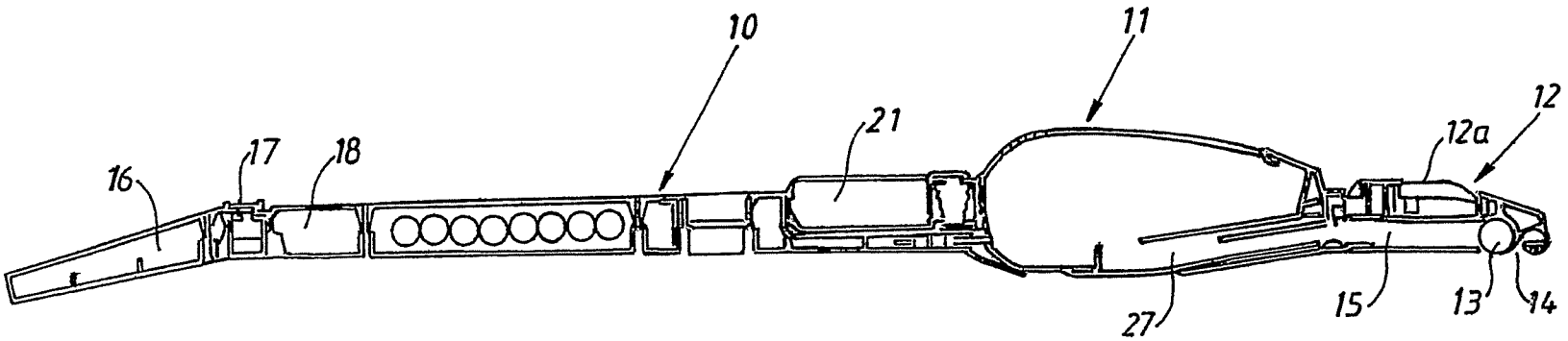
FIG. 2 is a schematic sectional view through the shaft part shown in FIG. 1.
Figure 3:
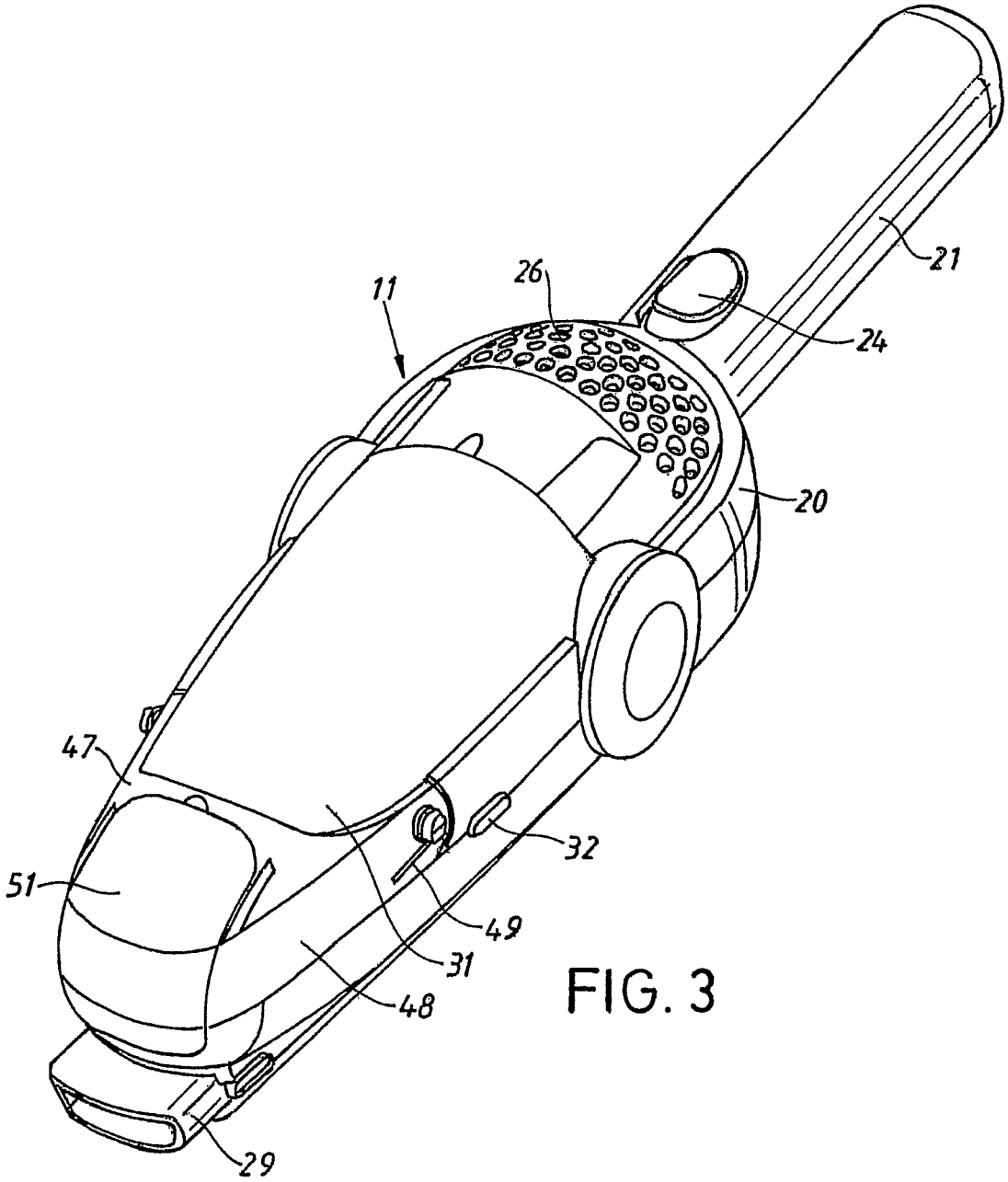
FIG. 3 is a perspective view of the vacuum cleaner being removed.
Figure 4:
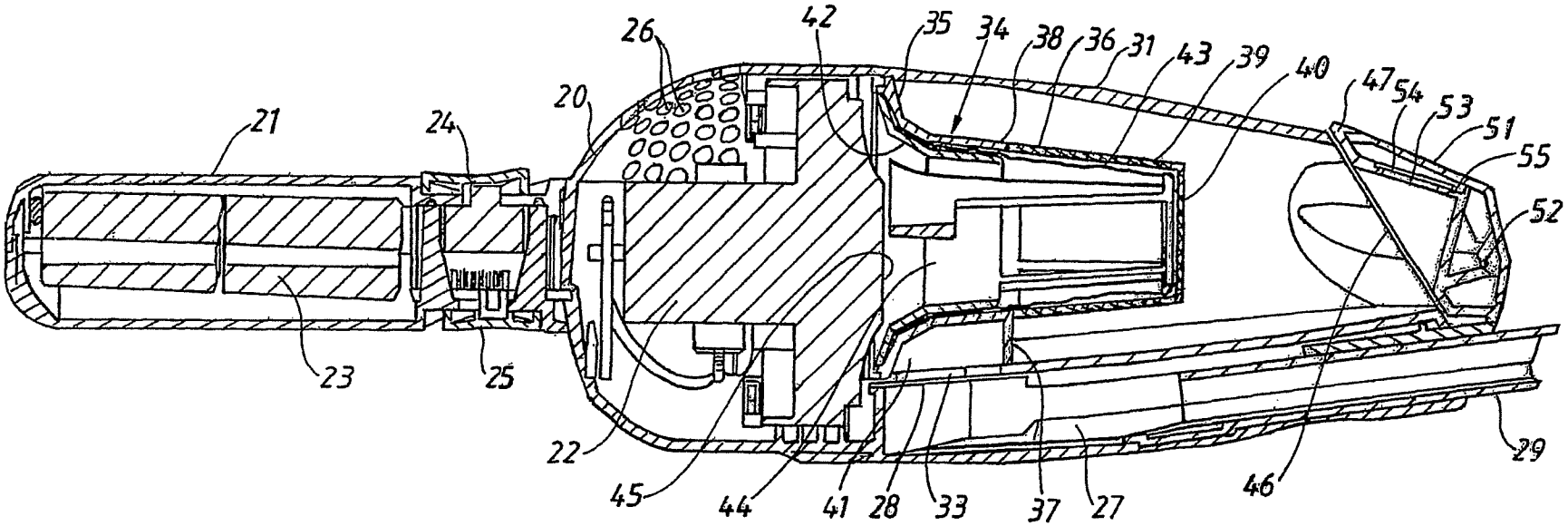
FIG. 4 is a sectional view through the vacuum cleaner.
Figure 5:
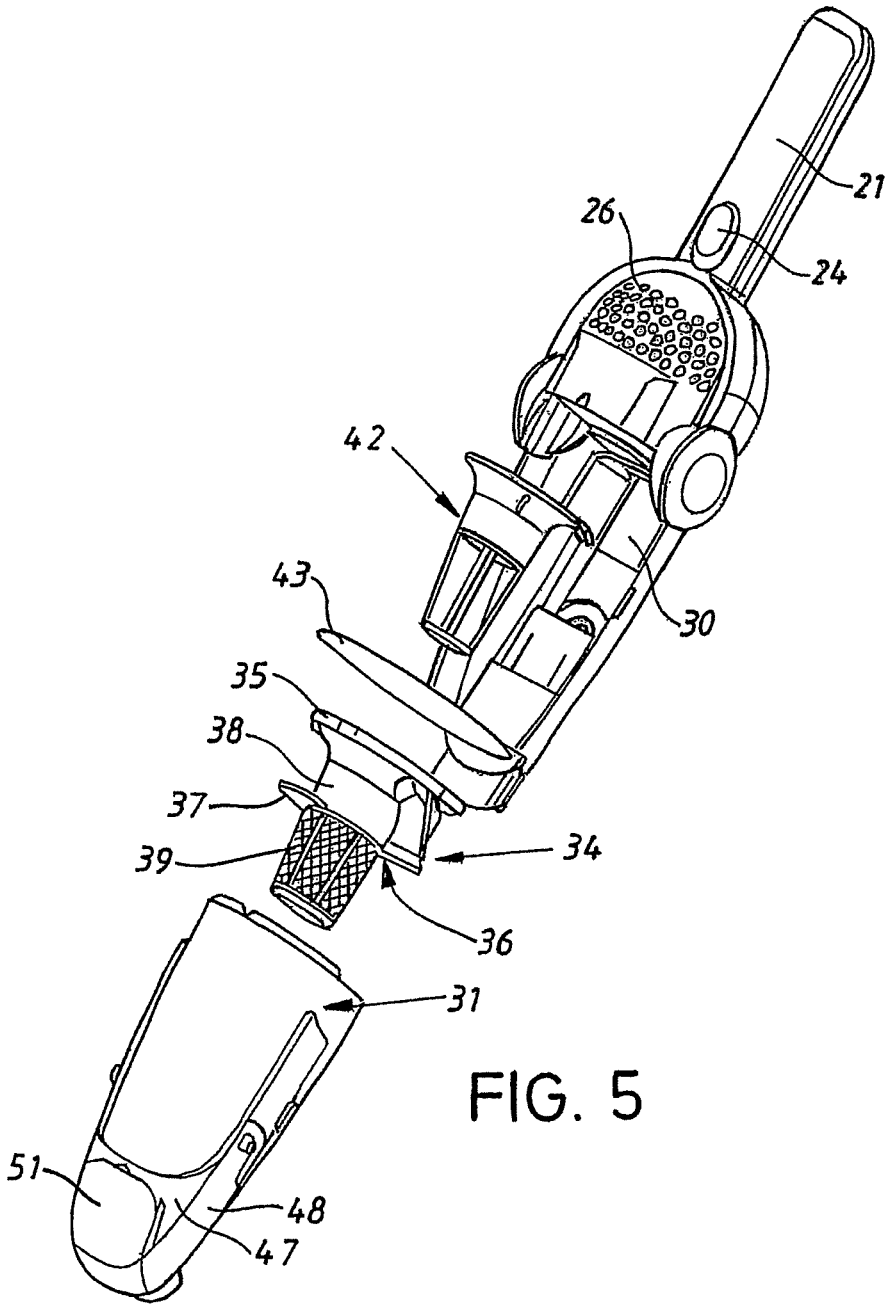
FIG. 5 is an exploded view showing the vacuum cleaner being separated and at the emptying procedure.
Figure 6:
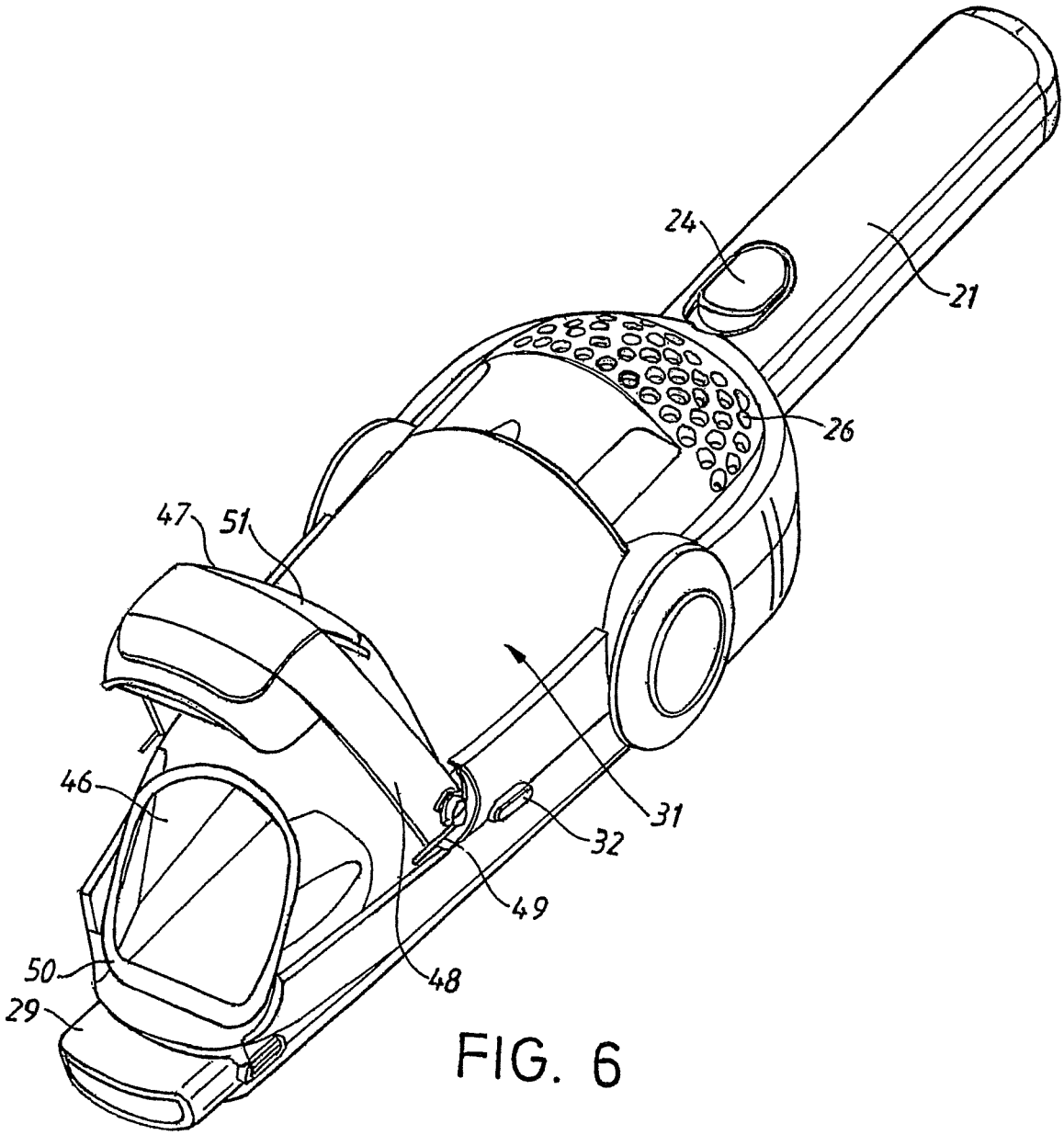
FIG. 6 is a perspective view of the vacuum cleaner showing a different method for emptying the vacuum cleaner whereas FIG. 7 in a perspective view shows a further method for emptying the vacuum cleaner.
Figure 7:
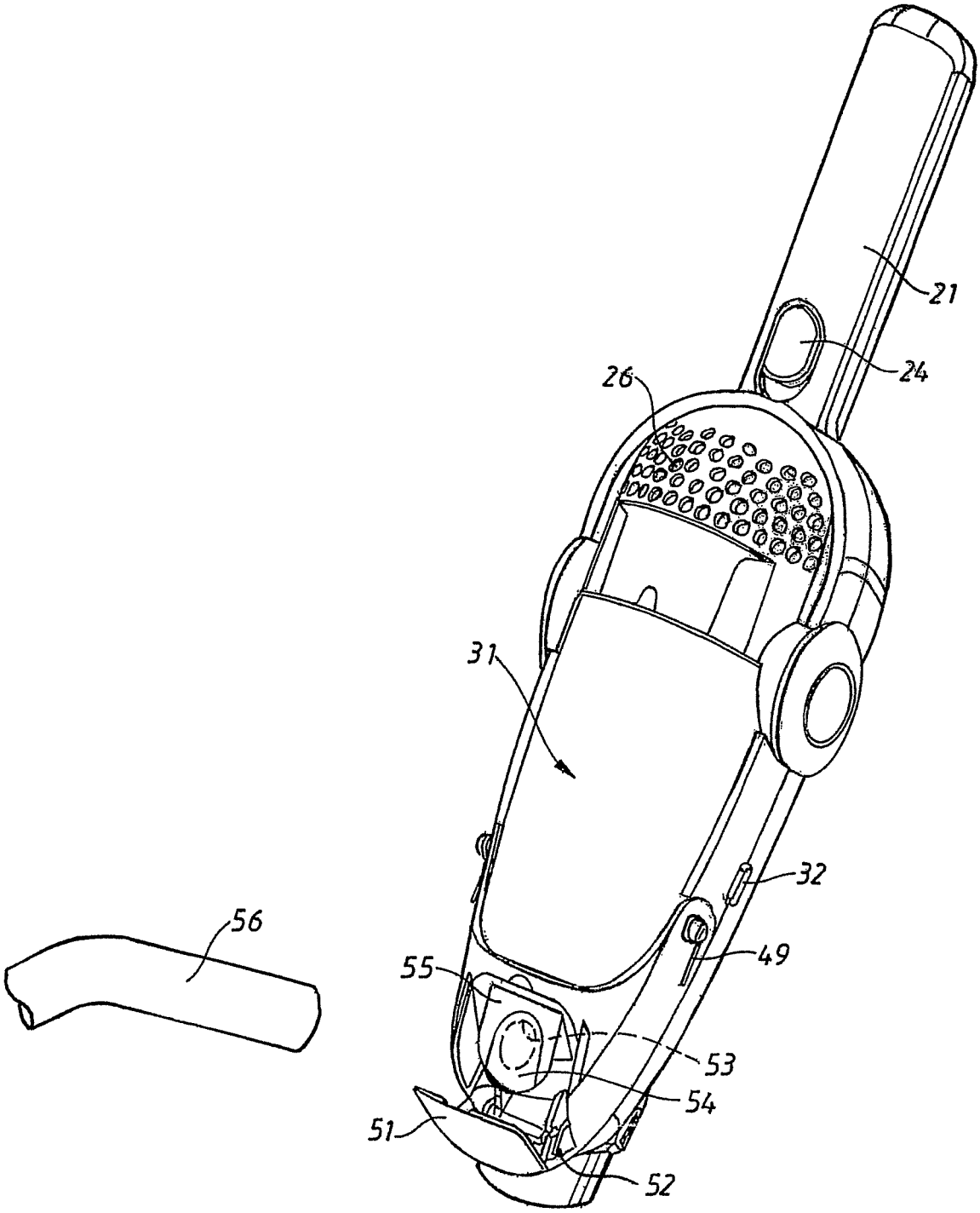

As appears from FIG. 1 the shown vacuum cleaner comprises an elongated shaft part 10 in which a hand held vacuum cleaner 11 is removably arranged. The lower end of the shaft part supports a floor nozzle 12 enclosing an electrically driven brush roll 13, not described in detail, and which is turnably secured to the shaft part 10. The nozzle has an elongated suction opening 14 extending in the length direction of the nozzle and the suction opening is via a flexible tube passage 15 connected to the hand held vacuum cleaner 11 in a manner which will be described below. The upper portion of the shaft part 10 is shaped as a handle 16 and has an operating knob 17 that via an electric circuit, not shown in detail, is connected to the hand held vacuum cleaner when it is secured to the shaft part. The shaft part might also enclose one or several batteries 18 which are connected to the electric circuit.

The nozzle 12 is provided with a supporting part 12*a* having one end that via a shaft is pivotally arranged about a first axis A extending mainly horizontally and mainly parallel to the suction opening 14. The other end of the supporting part 12*a* is pivotally secured to the lower portion of the shaft part 10 about a second axis B that is mainly perpendicular to the length direction of the shaft part 10 and to the first axis A. This means that there is a double link arrangement between the shaft part 10 and the nozzle 11, which gives an excellent maneuverability of the vacuum cleaner when being used as a stick cleaner. This arrangement also makes it possible to easily hide the electric wires between the shaft part 10 and the nozzle within the support arm 12*a*. In order to create a reliable nozzle link the shaft ends defining the axis A are supported by two shaft supports comprising separate units that are removably inserted into pockets in the nozzle.

The hand held vacuum cleaner 11 comprises a housing 20 with a handle 21 and the housing encloses a motor-fan unit 22 driven by one or several batteries 23 placed in the handle 21. The motor-fan unit is controlled by means of a control knob 24 placed at the handle and the part of the electric circuit which is placed in the hand held vacuum cleaner is via a connection 25 connected to the part of the circuit which is placed in the shaft part 10 when the hand held vacuum cleaner is fixed to the shaft part 10. The housing is provided with several openings 26 through which the air flowing through the fan unit leaves the housing. The housing also has an inlet channel 27 extending from the front part of the housing to an outlet opening 28 arranged at the middle part of the housing. In the channel 27 a tube part 29 is slidably arranged the outer end of the tube part being shaped as a nozzle. When the hand held vacuum cleaner is fastened to the shaft part the tube part 29 is pushed into the channel 27 and is thereby a direct continuation of the tube passage 15 of the shaft part. The tube part can also be pulled out to an extended position and by means of a retaining mechanism, not shown, be locked temporarily in the extended position.

The housing is provided with a recess 30 in which a dust container 31 is removably arranged the dust container being removed by means of locking knobs 32 arranged at each side of the container. The dust container 31 is shaped as an elongated body with an open end and is partly made of transparent material. Close to the open end of the dust container there is an inlet 33 that is coaxial to the outlet opening 28 of the channel 27. The open end is partly covered by a filter liner 34 that follows the dust container when it is removed from the housing but which is removably arranged with respect to the dust container. The filter liner comprises a collar shaped portion 35 resting against a seat arranged at the wall of the dust container the collar shaped portion continuing into a sleeve shaped portion 36 centrally arranged in the dust container. The sleeve shaped portion has a flange 37 overbridging the distance between the sleeve shaped portion 36 and the surrounding container wall and extends around a part of the circumference of the sleeve shaped portion. The part 38 of the sleeve shaped portion which is placed at one side of the flange 37 is together with the collar shaped portion 35 made by homogenous material whereas the part which is placed at the other side of the flange comprises a grating structure which is covered by a coarse filter 39 that also extends over the end 40 of the sleeve shaped portion. The coarse filter 39 preferably comprises a washable fine meshed plastic net. Further the filter liner 34 is provided with a radially extending wall 41 that stretches between the flange 37 and the collar shaped portion 35 close to the inlet 33. The wall 41 prevents the dust in the dust container from falling out through the inlet 33 if the vacuum cleaner should be turned up-side-down and also limits an annular flow channel around a part of the circumference of the filter liner 34. When dust laden air flows through this channel it contributes to the creation of a vortex in the dust container which will thus operate as a cyclone separator in which larger particles are separated from the air flow at the same time as the process is visualized through the transparent container wall. Thus, the cyclone prevents the filter from being clogged by means of larger dust particles and dirt. By means of the transparent container wall it is also possible to see the dust level in the container and hence also to establish when it is time to empty the container.

The filter liner 34 encloses a removable support body 42 for a fine filter 43 for instance a flat circular paper filter that can be clamped between the support body 42 and the filter liner 34. The support body 42 mainly has the same sleeve shape as the filter liner 34 but is somewhat smaller and forms a flow passage 44 for the air which flows through the coarse filter 39 and the fine filter 43 to the inlet opening 45 of the fan unit. Alternatively the fine filter can be replaced by a body of foamed plastic or the like to separate finer particles after the coarse filter whereby the body is secured in a suitable way in the filter liner.

The dust container has a large emptying opening 46 extending over the entire bottom part of the dust container and the opening is normally covered by a lid 47 supported by a yoke 48 turnably secured at each side of the dust container the yoke being acted on by two springs 49 normally pressing the lid against a seal 50 surrounding the opening 46.

The lid 47 supports a flap 51, that is turnably fastened to the lid 47 by means of dowels 52, and is normally hiding a small, circular emptying opening 53 which is connected to the inside of the dust container. This opening might be covered by a tongue 54 of elastic material which is fastened at one of its sides and rests against a seat 55 surrounding the opening 53 the tongue serving as a check valve that opens when a tube 56 connected to an outer vacuum source is pressed against the seat 55 or is inserted into the opening 53. Instead of using an elastic tongue it is of course possible to provide the seat 55 or the flap 51 with a sealing that prevents air from flowing through the emptying opening 53 into the dust container when the flap is closed.

The hand held vacuum cleaner is used and operates in the following manner. In normal use the hand held vacuum cleaner 11 is removed from the shaft part 10 after which the tube part 29 is pulled out to the outer position. Then the motor fan unit is started by acting on the operating knob 24. This means that air together with dirt particles are sucked in through the tube part 29 and the inlet channel 27. The dust laden air flows through the outlet opening 28 and the inlet 33 of the dust container 31 after which the dust laden air flows into the channel which is limited by the filter liner 34, the flange 37 and the wall of the dust container and extending around the sleeve shaped portion 36. Thereby a vortex is created in the dust container the vortex separating heavier particles from the air flow such that they can be collected at the bottom of the container. The air then flows further through the coarse filter 39 and the fine filter 43 to the flow passage 44 from which the cleaned air leaves to the inlet opening 45 of the fan unit. After having passed the fan unit the air then leaves to atmosphere via the openings 26.

In order to empty the hand held vacuum cleaner there are three different alternatives. By manually opening the lid 46 against the action of the springs 49 the operator can uncover the emptying opening 46 and the collected dust is allowed to fall freely out of the opening or to be shaken out through it. This means a quick emptying function without the need for removing the dust container from the hand held vacuum cleaner. A second quick emptying alternative is, when the operator uses a larger type of vacuum cleaner during a conventional vacuum cleaning operation, to open the flap 51 and press the inlet opening of the tube handle 56 of the larger vacuum cleaner against the seat 55. This means that the tongue 54 because of the vacuum created by the larger vacuum cleaner will uncover the opening 53 and the content in the dust container 31 will be sucked over to the dust container of the larger vacuum cleaner. Thereby also the coarse filter 39 and the fine filter 43 will be cleaned by the air that flows backwards through the hand held vacuum cleaner. A further emptying alternative is to remove the dust container 31 from the housing 20 by acting on the locking knobs 32. Thereby the dust container is removed together with the filter liner 34, the fine filter 43 and the support body 42. By removing the last mentioned three parts from the dust container it can be emptied and the dust container 31, the filter liner 34 with the coarse filter 39 and the support body 42 can be cleaned separately and a new fine filter 43 can then be applied on the support body 43 before it is again inserted into the filter liner 34. The filter liner will then be folded such that it achieves a large filter area. The filter liner 34 can then again be inserted into the dust container 31 before the dust container is locked in the housing 20.

The hand held vacuum cleaner 11 can, if the operator so desires, be fixed to the shaft part 10 whereby the tube part 29 is moved to its retracted position at the same time as the electrical circuit of the hand held vacuum cleaner via the connection 25 is connected to the electrical circuit in the shaft part. This means that the motor fan unit of the hand held vacuum cleaner and the electric motor of the brush roll 13 now can be activated by means of the operating knob 17 whereby additional energy is supplied by means of the batteries 18 in the shaft part. The shaft part can then be used as a normal so called stick cleaner for cleaning larger surfaces such as a floor whereby dust laden air is sucked in through the nozzle 12. This air via the flexible tube passage 15 passes to the inlet channel 27 of the hand held vacuum cleaner after which the dust particles are separated in the dust container 31 in a manner described above.

It should be stressed that the hand held vacuum cleaner and/or the shaft part in a conventional manner is provided with a connection, not shown, for an electrical charger to charge the batteries which are placed in the shaft part and/ or the hand held vacuum cleaner. The vacuum cleaner might of course also be mains supplied.

The invention claimed is:

1. A vacuum cleaner apparatus for operatively securing a hand held vacuum cleaner (11) having a housing (20) comprising a motor-fan unit (22), a dust container (31), and an air passage (27), the vacuum cleaner apparatus comprising:

a shaft part (10) to which the housing can be removably secured, the shaft part comprising a handle (16) and one or more batteries (18);

a floor nozzle (12); and a tube passage (15) configured to connect the floor nozzle to the air passage when the housing is secured to the shaft part.

2. The vacuum cleaner apparatus according to claim 1, wherein the shaft part (10) further comprises an electric circuit operably connected to said one or more batteries (18).

3. The vacuum cleaner apparatus according to claim 2, wherein at least a part of the electric circuit is operably connected to the hand held vacuum cleaner (11) via a connection (25) when the housing (20) is secured to the shaft part (10).

4. The vacuum cleaner apparatus according to claim 3, wherein the shaft part (10) further comprises an operating knob (17) that is operably connected to the hand held vacuum cleaner (11) via at least a part of the electric circuit when the housing (20) is secured to the shaft part.

5. The vacuum cleaner apparatus according to claim 1, wherein the shaft part (10) further comprises an electrical charger connection to charge the one or more batteries (18).

6. The vacuum cleaner apparatus according to claim 1, wherein the floor nozzle (12) comprises an electrically driven bush roll (13).

7. The vacuum cleaner apparatus according to claim 6, wherein the electrically driven bush roll (13) is driven by an electric motor, said motor receiving energy from the one or more batteries (18).

8. The vacuum cleaner apparatus according to claim 1, wherein the motor-fan unit (22), when activated, is supplied with energy by means of the one or more batteries (18) when the housing (20) is secured to the shaft part (10).

* * * * *